US006488151B2

(12) United States Patent
Ramsey et al.

(10) Patent No.: US 6,488,151 B2
(45) **Date of Patent: *Dec. 3, 2002**

(54) ADJUSTABLE SOCKET RACK WITH COAXIAL CLAMP

(76) Inventors: Edward Ramsey, 38265 E. Benton Rd., Temecula, CA (US) 92592; Chris Vovos, 15505 Carrington Dr., La Mirada, CA (US) 90638

( * ) Notice: Subject to any disclaimer, the term of this patent is extended or adjusted under 35 U.S.C. 154(b) by 0 days.

This patent is subject to a terminal disclaimer.

(21) Appl. No.: 09/753,278

(22) Filed: Dec. 28, 2000

(65) Prior Publication Data

US 2001/0001197 A1 May 17, 2001

Related U.S. Application Data

(63) Continuation-in-part of application No. 09/398,717, filed on Sep. 20, 1999, now Pat. No. 6,168,018.

(51) Int. Cl.[7] ..... B65D 85/20; A47F 7/00

(52) U.S. Cl. ..... 206/378; 211/70.6

(58) Field of Search ..... 206/375, 376, 206/378, 493; 211/70.6, 69.5

(56) References Cited

U.S. PATENT DOCUMENTS 4,621,738 A * 11/1986 DeLucchi ..... 211/70.6
4,717,106 A * 1/1988 Bies et al. ..... 211/70.6
4,826,021 A * 5/1989 Burrell ..... 211/70.6
4,927,020 A * 5/1990 Randy ..... 206/378
5,228,570 A * 7/1993 Robinson ..... 206/378
5,398,823 A * 3/1995 Anders ..... 211/70.6
5,467,874 A * 11/1995 Whitaker ..... 206/378
5,501,342 A * 3/1996 Geibel ..... 206/378
5,645,177 A * 7/1997 Lin ..... 211/70.6
5,715,951 A * 2/1998 Dembicks ..... 211/70.6
5,725,107 A * 3/1998 Dembicks ..... 211/70.6
5,827,487 A * 10/1998 Holmes ..... 211/70.6
6,092,655 A * 7/2000 Ernst ..... 206/378
6,168,018 B1 * 1/2001 Ramsey et al. ..... 206/378

* cited by examiner

*Primary Examiner*—Bryon P. Gehman
(74) *Attorney, Agent, or Firm*—Charles H. Thomas

(57) ABSTRACT

A wrench socket rack is formed of an elongated support defining a track with a pair of bearing surfaces overhanging the track from opposite sides. A plurality of socket pegs are provided. Each peg has a base with laterally projecting lugs that fit into the track. Each socket peg is sized to receive a wrench socket thereon. A bore with internal threads is defined from top to bottom in each of the socket pegs. A track-engaging clamp formed as a set screw that is threadably engaged in the socket peg at the bottom end of the bore. A hollow spring clamping screw is threadably engaged in the top end of the bore. The track-engaging set screw may be manipulated using a tool that is inserted through the cylindrical opening in the spring clamping screw.

16 Claims, 3 Drawing Sheets

ADJUSTABLE SOCKET RACK WITH COAXIAL CLAMP

The present application is a continuation in part of U.S. application Ser. No. 09/398,717 filed Sep. 20, 1999, now U.S. Pat. No. 6,168,018.

SPECIFICATION

Background of the Invention

1. Field of the Invention

The present invention relates to an improvement in an adjustable rack for receiving sockets of different sizes that are used with a socket wrench.

2. Description of the Prior Art

Our prior U.S. application Ser. No. 09/398,717 filed Sep. 20, 1999 describes a wrench socket rack in which the positions of socket mounts are adjustable along the length of a track. That application is hereby incorporated herein by reference in its entirety. In this system an internally tapped threaded bore extends longitudinally throughout the length of the socket mount from the upper end of a socket peg to the bottom of the base of the socket mount. The base has laterally projecting lugs that extend beneath and face bearing ledges that overhang the track. Leaf springs are provided that are anchored to the top of each stud peg and which extend downwardly along one side of the stud. A single long screw that is threadably engaged in the internally tapped threaded bore of the socket mount serves the dual purpose of anchoring the upper end of the leaf spring and immobilizing the socket mount relative to the track.

While this prior system works quite well, it does require very close tolerances in the dimensions of the socket mount, the track, and the length of the screw. If the screw is too long or the distance between the bearing ledges and the bottom of the track is too narrow, the head of the screw will not clamp tightly against the anchored end of the leaf spring. As a result, the leaf spring will not adequately perform its function of holding a wrench socket on the socket peg. Conversely, if the screw is too short or the distance between the bearing ledges and the bottom of the track is too great, the head of the screw will clamp the anchored end of the leaf spring against the top of the socket peg before the distal tip of the screw fully engages the track. As a consequence, the socket mount will not be completely immobilized from longitudinal movement along the track.

SUMMARY OF THE INVENTION

The present invention solves the dilemma of inflexible tolerances in the construction of the adjustable wrench socket rack described by substituting two independently adjustable screws for the single screw of the prior invention. Moreover, a way has been devised to allow each of these two screws to be accessible for manipulation from the top of the socket mount. This is possible by constructing the upper screw, that is the screw that clamps the anchored end of the leaf spring, as a hollow screw having a cylindrical passage or tunnel down its center. This permits a narrow, elongated tool, such as a narrow screwdriver blade or a narrow allen wrench to be inserted through the longitudinal passage of the spring clamping screw from above the socket mount to engage the lower screw located at the base of the socket mount. This lower screw serves as a set screw to immobilize movement of the socket mount along the track. The upper screw can be independently adjusted to tightly clamp the anchored end of the spring against the top of the socket mount peg.

In one broad aspect the present invention may be considered to be an adjustable wrench socket rack comprising an elongated mounting strip, a plurality of socket mounts, each including a mounting base and a socket mounting post projecting upwardly from the base, and a track-engaging clamp that is releaseable to permit longitudinal movement of the mounting base along the track and engageable to immobilize the mounting base relative to the track, wherein said track-engaging clamp is accessible for release and engagement from above the top surface of the socket mounting post through the internally tapped bore.

In a preferred embodiment of the invention resilient clips are provided to releaseably grasp the mounting strip from opposing sides. The resilient clips each have a generally U-shaped configuration. The bottom, central base of each clip is secured to an underlying rack support, such as the floor of a toolbox tray, a workbench surface, or any other stable supporting surface upon which the adjustable wrench socket rack of the invention is to be stored. A pair of resilient arms project upwardly from the opposing ends of each clip. The tips of each of the resilient arms are directed toward each other. The elongated mounting strip of the adjustable wrench socket rack of the invention can be pressed downwardly in between the resilient arms of one or a plurality of the clips. The resilient arms elastically deflect to permit the mounting strip to seat upon the central portions of the clips. The tips of the resilient arms then spring back over the outer edges of the mounting strip to capture it within their grasp.

The invention may be described with greater clarity and particularity by reference to the accompanying drawings.

DESCRIPTION OF THE EMBODIMENT

Figure 1:
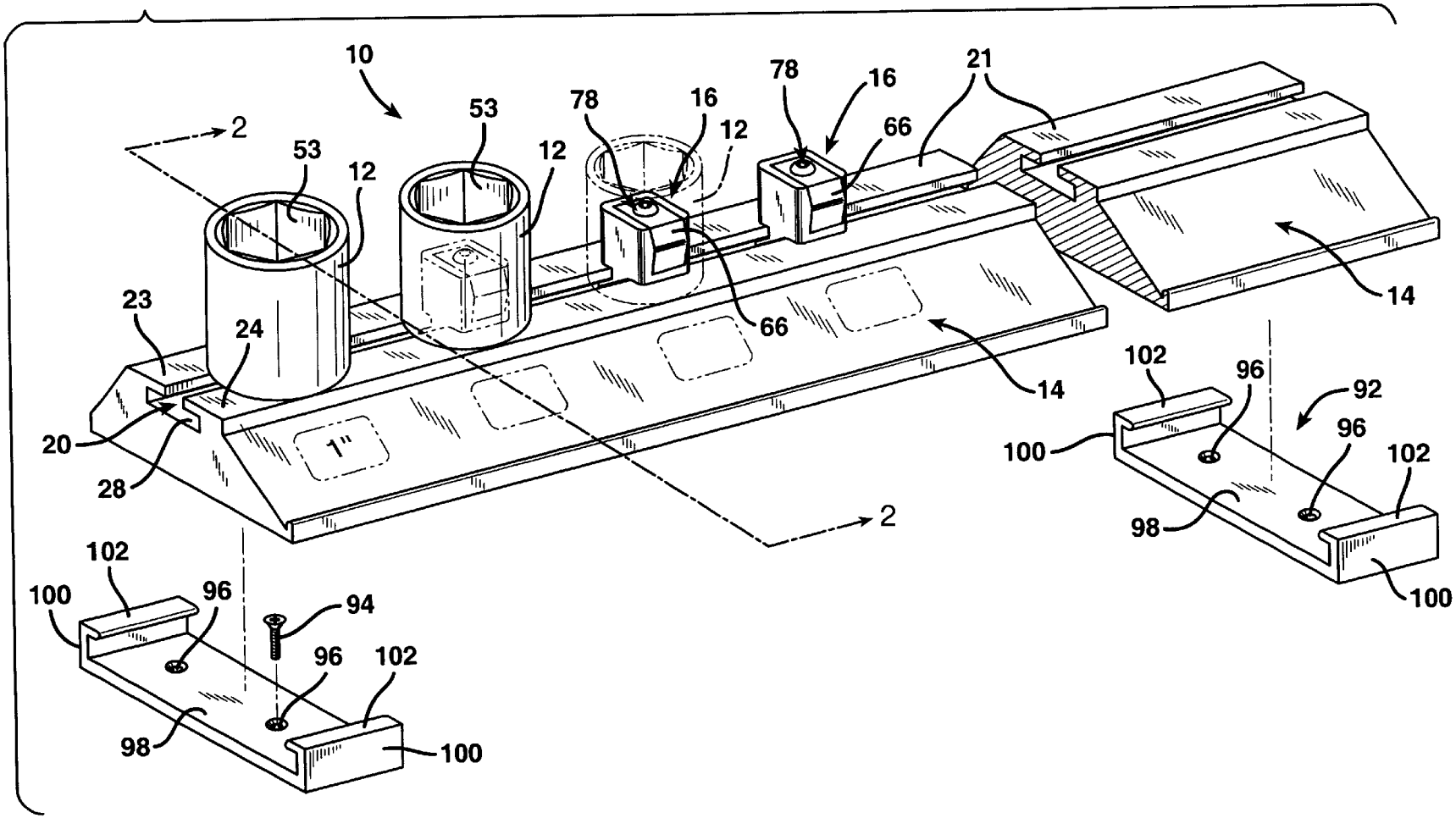
FIG. 1 is a perspective view, partially exploded, of one preferred embodiment of a wrench socket rack according to the invention.

FIG. 1 illustrates a wrench socket rack 10 according to the invention for accommodating a plurality of wrench sockets 12, several of which are illustrated in FIG. 1. Each socket 12 has a square drive opening 52 at one end and a nut or bolt-head-engaging opening 53 at its opposite end, as best shown in the phantom portion of FIG. 2. The wrench socket rack 10 is comprised of an elongated support 14, which is formed as a mounting strip structure having a uniform cross section throughout its entire length, and a plurality of socket mounts or pegs 16, each one of which is of the type depicted in FIGS. 2 and 3.

Figure 2:
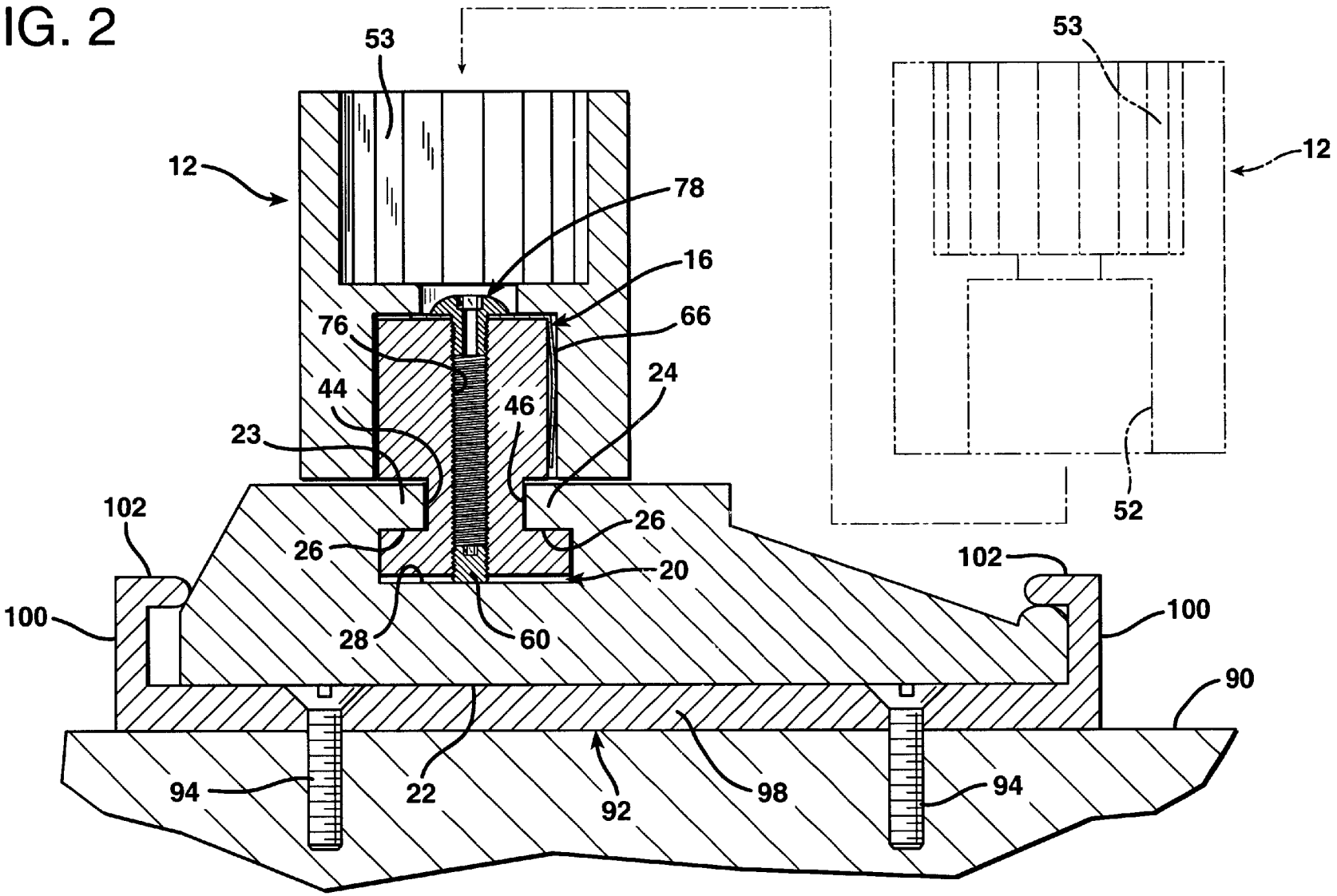
FIG. 2 is a sectional elevational view of the wrench socket rack of FIG. 1, taken along the lines 2—2 thereof.

As best illustrated in FIGS. 1–2, the elongated support 14 is formed with an elongated track 20, which has the cross-sectional configuration of an inverted "T". The mounting strip 14 has a flat bottom 22 and a flat top socket-mounting surface 21 located above the flat bottom 22. The track 20 is formed as a channel beneath the flat socket-mounting surface 21.

The elongated support 14 is an extruded aluminum structure which forms a pair of overhanging flanges 23 and 24 that are below the flat upper surface 21 and that extend along the sides of the track 20 and which define downwardly or inwardly facing bearing surfaces or ledges 26 on both sides of the track 20. The bearing surfaces 26 overhang and face the upwardly or outwardly facing track floor 28.

Figure 3:
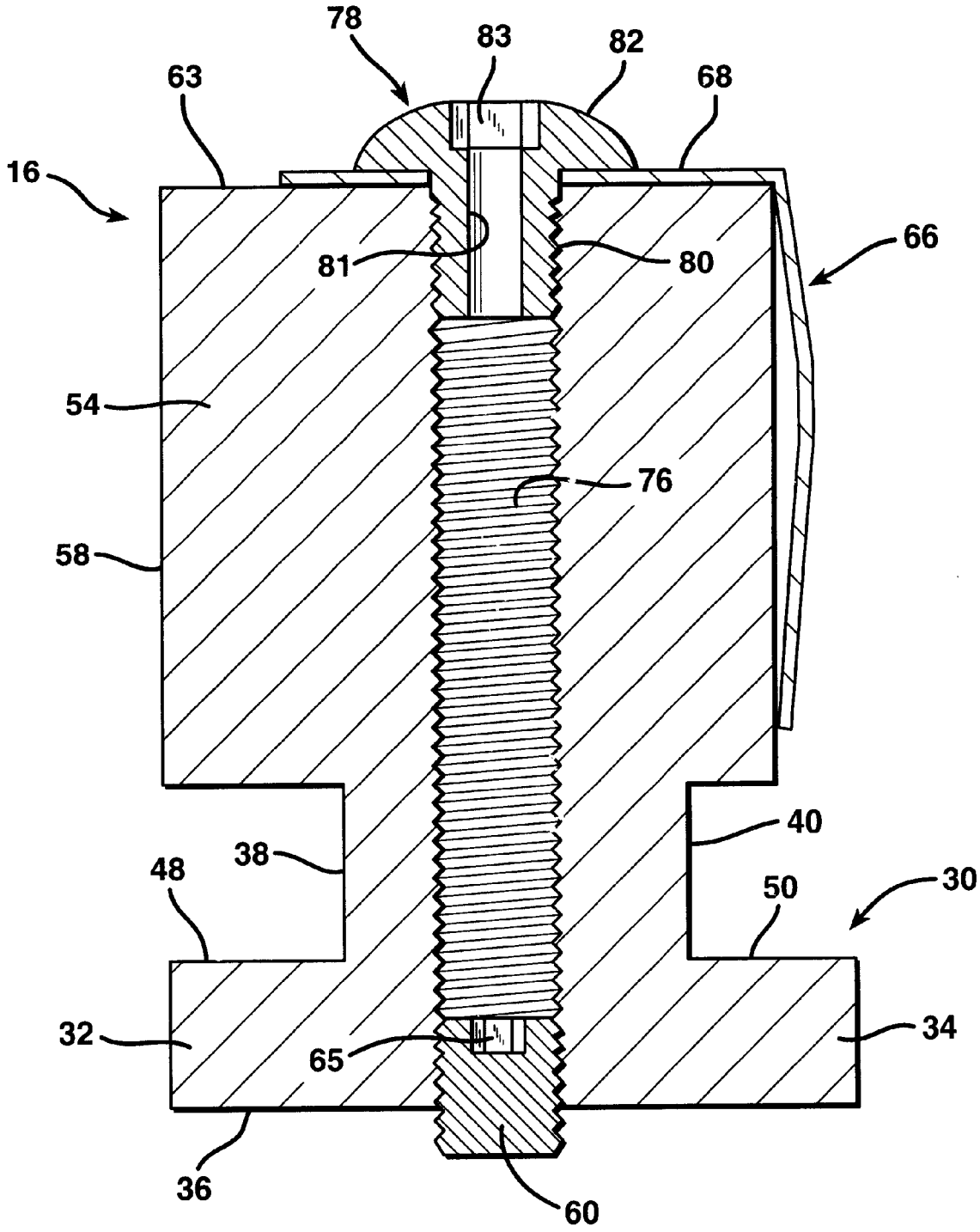
FIG. 3 is a sectional elevational detail of the socket mount, socket-engaging leaf spring, hollow spring-anchoring fastener, and track-engaging clamp shown in FIG. 2.

The socket mounts 16 have different cross-sectional configurations, depending upon the drive size which the sockets 12 are designed to accommodate. However, irrespective of the drive stud sockets that the socket mounts are designed to receive, all of the socket mounts 16 include a socket mount base 30 that has a pair of opposing bearing lugs 32 and 34. FIG. 3 illustrates a socket mount 16 designed to receive sockets 12 that have a square opening to receive a one-half inch square socket wrench drive stud. The lugs 32 and 34 project to opposite sides of the flat base undersurface 36 of the socket mount 16. The lugs 32 and 34 are defined at the neck of the socket mount 12 by vertical surfaces 38 and 40 that are spaced a predetermined distance apart so that the neck of each socket mount 16 above the base 30 projects upwardly through the gap at the top of the track 20 defined between the vertical, mutually facing surfaces 44 and 46 of the overhanging flanges 23 and 24.

As illustrated in FIG. 2, the opposing lugs 32 and 34 extend laterally beneath the bearing ledges 26 that are formed above the track 20. The lugs 32 and 34 are just thick enough, as measured between their upper, flat, horizontal surfaces 48 and 50 and the underside 36 of the base 30, to fit with a slight clearance into the T-shaped track 20. For example, in the embodiment of the mounting strip 14 depicted in FIGS. 1 and 2, the floor 28 of the track 20 may be 0.510 inches wide and the mounting strip 14 may be extruded so that the bearing ledges 26 lie at a distance of 0.125 inches above the track floor 28. The gap at the top of the track, as defined by the distance between the vertically facing surfaces 44 and 46 of the track flanges 22 and 24, may be 0.260 inches. For a track 20 having these dimensions, the flat bottom surface 36 of the base 30 the socket mount 16 shown in FIG. 3 may be 0.500 inches wide, while the distance between the mutually coplanar upper surfaces 48 and 50 of the lugs 32 and 34 from the bottom surface 36 of the base 30 may be 0.110 inches. The vertical surfaces 38 and 40 may, for example, extend upwardly a distance of at least 0.135 inches so as to clear the flat, upper surface 21 of the mounting strip 14 in which the track 20 is formed.

To accommodate sockets 12 having a one-half inch square drive opening 52, as illustrated in FIG. 2, the socket mount 16 is provided with a socket-engaging stud 54 of rectangular cross section and which has upright, vertically oriented, laterally facing side surfaces 56 and 58 that are located 0.425 inches apart, and upright, mutually parallel end faces that are located 0.495 inches apart.

The structures forming the socket mount bases 30 and the socket-engaging studs 54 of each socket mount 16 are formed by cutting off sections of die cast aluminum bar stock. This bar stock has a uniform cross-sectional configuration as depicted in FIG. 3.

The socket-mounting stud 54 has a flat, upper top surface 63 that is parallel to the flat, lower bottom surface 36 of the socket mount base 30. The overall height of the socket mount 16, as measured by the distance between the surfaces 36 and 63 is preferably about 0.72 inches.

Each of the socket mounts 16 is formed with an internally tapped bore 76, visible in FIG. 6, which extends entirely through the height of the socket mount 16 from top to bottom, with openings at both the flat upper top surface 63 and at the flat bottom undersurface 36. The internally tapped bore 76 may have a pitch diameter of one-eighth of an inch with 6–32 threads, for example.

The width of each socket mount stud 54 is slightly thinner in a lateral direction than in a transverse direction so as to accommodate a socket-engaging spring 66, as illustrated in FIGS. 2 and 3. The socket-engaging spring 66 is a leaf spring having an anchored end 68 that is formed as a flat tab at the upper end of the leaf spring 66. The tab 68 has an opening defined therethrough. The anchoring end tab 68 is secured to the top of the stud 54 in face-to-face contact with the flat top surface 63 of the socket mount stud 54. The leaf spring 66 also has a longer, free end 70 that projects downwardly along the lateral side 56 of the stud 54 and is bowed convex outwardly from the surface 56, as illustrated in FIG. 3.

Each socket mount 16 is provided with a hollow spring-anchoring fastener which, in the embodiment of the invention illustrated, is a hollow, spring-anchoring clamping screw 78, having a short, externally threaded shank 80 and an oval head 82. The shank 80 of the spring-anchoring clamping screw 78 is preferably only about three-sixteenths of an inch in length. A cylindrical bore 81 having a diameter of 0.070 inches is defined longitudinally down the center of the screw shank 80. A five sixty-fourths inch hexagonal socket 83 is defined in the screw head 82. The cylindrical bore 81 forms a circular opening at the center of the bottom of the socket 83. The hex socket 83 is adapted to receive the end of an allen wrench. When fully tightened down into the upper end of the internally tapped bore 76, the spring-anchoring fastener screw 78 clamps the anchored end 68 of the leaf spring 66 against the top upper surface 63 of the stud 54.

A short, mount-clamping screw 60 is threadably engaged in the bore 76 at the opposite, lower end of the base 30. The mount-clamping screw 60 is a set screw, the lower face 61 of which bears against the floor 28 of the track 20 when the set screw 60 is advanced downwardly and when the socket mount 16 is engaged in the track 20. The upper end of the set screw 60 has a longitudinally directed 0.050 inch hexagonal allen head socket 65 defined therein The set screw 60 may be threadably advanced toward the track floor 28 by clockwise rotation and advanced back from the floor 28 by counterclockwise rotation from above the top of the socket mount 16.

The mount-clamping screw 60 is engaged in the bore 76 at the bottom opening in the base 30. The mount-clamping screw 60 is accessible for manipulation through the bore 81 of the hollow, spring-anchoring fastening screw 78 and through the upper portion of the internally threaded bore 76 that extends the length of the socket mount 16. To tightened or loosen the set screw 60, the user inserts the shank of a 0.050 allen head wrench down through the central bore 81 of the spring clamping screw 78 until the tip of the wrench is engaged in the hex socket 65. The allen head wrench is then turned clockwise to tighten the screw 60 down into tight contact with the floor 28 of the track 20 to immobilize the base 30 of the socket mount 16 relative to the track 20. This action presses the lugs 32 and 34 of the socket mount base 30 up against the bearing ledges 26. Counterclockwise rotation of the allen head wrench engaged with the set screw 60 withdraws the lower tip 61 of the set screw 60 from frictional engagement with the floor 28 of the track 20, thereby allowing the socket mount 16 to be moved longitudinally and repositioned as desired along the length of the track 20.

In the embodiment of the invention illustrated the wrench socket rack 10 is positioned atop an underlying surface 90, which may, for example, be the floor of a toolbox tray. The wrench socket rack 10 is further comprised of a pair of resilient mounting clips 92 which are formed of injection molded nylon. Each of the clips 92 is formed as a generally U-shaped structure having a central portion 98 and a pair of upright arms 100 that rise from the central portion 98. The mounting clips 92 are engaged with the underlying surface 90 by means of screws 94 that project through openings 96 in the central portion 98 of the clips 92.

The tips 102 of the arms 100 are turned in toward each other to overhang the ends of the central portion 98. The pair of opposing arms 100 of each of the clips 92 is thereby aligned perpendicular to the track 20. The tips 102 of the resilient clip arms 100 engage the elongated mounting strip 14 from opposite sides, as best illustrated in FIG. 2.

By providing the wrench socket rack 10 with resilient clips 92 the elongated mounting strip 14 can be firmly attached to the underlying support 90 or moved about to a more convenient location as desired. The clips 92 provide the user with an additional convenient feature for storage and access for the wrench sockets 12.

Undoubtedly, numerous variations and modifications of the invention will become readily apparent to those familiar with wrench socket racks. For example, it is possible to create a slot in the upper portion of the socket mount peg and anchor the leaf spring-anchoring tab in the slot by crimping. Also, the hollow spring-anchoring fastener does not necessarily need to be a screw threadably engaged in the bore through the socket mount. It could instead be a hollow pop rivet. Accordingly, the scope of the invention should not be construed as limited to the specific embodiment depicted and described, but rather is defined in the claims appended hereto.

What is claimed is:

1. An adjustable rack for wrench sockets comprising:

an elongated mounting strip defining an outwardly facing track thereon of uniform cross-section throughout having opposing lateral sides, and a pair of elongated, inwardly facing bearing ledges along both of said lateral sides of said track that are coextensive with said track, a plurality of modular socket mounts each of which includes a mount structure defining a base positioned in said track and having a pair of opposing bearing lugs that extend laterally beneath said bearing ledges and face said bearing ledges and a downwardly facing bottom surface at the lower extremity of said base, thereby permitting longitudinal movement of said base along said track while maintaining said base engaged with said track, and a socket-engaging stud projecting outwardly from said base and away from said track and having lateral sides and a top surface remote from said base, and a straight, bore extending entirely through said mount structure and defining a bottom opening in said bottom surface of said base and a top opening in said top surface of said stud, and said bore is internally threaded, a socket-engaging leaf spring having an anchoring end located proximate said top opening in said stud and a free end projecting downwardly along one of said lateral sides of said stud and bowed convex outwardly therefrom, a hollow spring-anchoring fastener engaged in said bore at said top of said stud and which immovably secures said anchoring end of said leaf spring relative to said stud, and a mount-clamping screw threadably engaged in said bore at said bottom opening in said base and accessible for manipulation through said hollow spring-anchoring fastener and through said bore, whereby said mount-clamping screw is selectively releaseable to permit said mount structure to be moved to a selected position along said track and engaged to press said lugs against said bearing ledges, thereby immobilizing said base relative to said track, whereby each of said socket mounts is independently adjustable relative to said track.

2. An adjustable rack according to claim 1 further characterized in that said anchoring end of said leaf spring has an opening therethrough and is located atop said top surface of said stud, and said hollow spring-anchoring fastener has a head that bears downwardly against said anchoring end of said leaf spring and a shank that projects through said opening in said anchoring end of said leaf spring and into said bore.

3. An adjustable rack according to claim 2 wherein said hollow spring-anchoring fastener is a hollow screw threadably engaged in said bore.

4. An adjustable rack according to claim 3 wherein both said mount-clamping screw and said hollow screw have upwardly facing, coaxial alien head sockets defined therein and said alien head socket of said hollow spring-anchoring screw has a bottom opening therein.

5. An adjustable rack according to claim 1 further comprising mounting clips with means for securement to an underlying rack support, and a pair of resilient arms for releaseably grasping said mounting strip from opposing sides thereof.

6. An adjustable wrench socket rack comprising:

an elongated mounting strip defining an elongated track of uniform cross-section throughout and equipped with an outwardly facing floor and a pair of laterally separated, inwardly facing, elongated bearing surfaces above said floor on both sides of said track, a plurality of socket mounts of modular construction, each socket mount including:

a mounting base having an inwardly facing bottom surface facing said floor of said track and a pair of opposing lugs projecting laterally beneath said elongated bearing surfaces, a socket mounting post projecting outwardly from said base for receiving a wrench socket thereon in snug fitting engagement therewith and having an outwardly facing top surface, and wherein each of said socket mounts is formed with an internally tapped bore that extends entirely through said base and through said socket mounting post so that said bore defines opposing openings at said bottom surface and at said top surface, a track-engaging clamp that is releaseable to permit longitudinal movement of said mounting base along said track and engageable to press said lugs against said bearing surfaces, thereby immobilizing said mounting base relative to said track, and said track-engaging clamp for each of said socket mounts is a screw engaged with said internally tapped bore thereof and is tightenable to protrude through said opening in said bottom surface to bear against said track so as to force said lugs against said bearing surfaces, and is releaseable to permit longitudinal movement of said socket mount relative to said track, and said track engaging clamp is accessible for release and engagement from above said top surface of said mounting post through said opening therein and through said internally tapped bore.

7. An adjustable wrench socket rack according to claim 6 further comprising a spring for each of said socket mounts that acts laterally from said socket mounting post to releaseably hold a wrench socket on said socket mounting post, and a hollow spring-anchoring fastener for each of said socket mounts located at said top surface of said post and engaged in said bore to anchor said spring to said post and which affords access to said track-engaging clamp therethrough.

8. An adjustable wrench socket rack according to claim 7 wherein said spring is a leaf spring having an anchored end and a free end located alongside said mounting post, and said hollow spring-anchoring fastener is a hollow screw threadably engaged in said bore to clamp said anchored end of said leaf spring against said top surface of said socket mounting post.

9. An adjustable wrench socket rack according to claim 6 further comprising a rack support underlying said elongated mounting strip and track mounting clips releaseably engageable with said mounting strip and attached to said rack support.

10. An adjustable wrench socket rack according to claim 9 wherein said track mounting clips have a pair of opposing resiliently deflectable arms for releaseably engaging said mounting strip.

11. An adjustable wrench socket rack according to claim 10 wherein said clips are formed as resilient plastic extrusions.

12. A wrench socket rack for accommodating a plurality of wrench sockets comprising:

an elongated support defining thereon an elongated track and a pair of bearing surfaces overhanging said track on opposite sides thereof, a plurality of socket pegs each of which includes: a base that fits into said track and which has a lower, bottom surface and a pair of opposing, laterally projecting lugs extending beneath said bearing surfaces; a stud projecting outwardly from said base and away from said track and having an upper top surface and sized to receive a wrench socket thereon in frictional engagement therewith; and wherein each of said socket pegs has a bore with internal threads therein extending entirely through the structure of each of said socket pegs from said stud to said base and said bore defines opposing bottom and top end openings in the said bottom and top surfaces, respectively, a track-engaging clamp that is releaseable to permit said base to slide longitudinally to a selected position along said track and engageable to press said lugs against said bearing surfaces to thereby lock each of said socket pegs at a selected position along said track, and said track-engaging clamp is formed as a set screw threadably engaged in said bore at said bottom surface of said base and directed toward said track and said set screw has a bearing tip that protrudes from said bore through said opening in said bottom surface of said base to bear against said track when said set screw is advanced into said bore toward said base, and said set screw is engageable through said top end opening in said top surface of each of said socket pegs.

13. A wrench socket rack according to claim 12 further comprising a laterally acting leaf spring secured to each stud of each socket peg to aid in releaseably retaining wrench sockets on said socket pegs, and each of said leaf springs has an anchored end with an opening therethrough, and each socket peg has a hollow leaf spring fastener, and said leaf spring fasteners extend through said openings in said anchored ends of said leaf springs and through said openings in said top surfaces of said socket pegs to engage said bores in said socket pegs.

14. A wrench socket rack according to claim 13 wherein said hollow leaf spring fasteners are hollow screws engaged in said bores at said top surfaces of said socket pegs.

15. A wrench socket rack according to claim 12 further comprising an underlying surface and resilient mounting clips engaged with said underlying surface and releaseably engageable with said elongated support to couple said elongated support to said underlying surface.

16. A wrench socket rack according to claim 15 wherein said resilient mounting clips each have a pair of opposing arms aligned perpendicular to said track and which engage said elongated support from opposite sides.

* * * * *